United States Patent [19]

Franco

[11] Patent Number: 4,776,061

[45] Date of Patent: Oct. 11, 1988

[54] ARTICULATED FURNITURE HINGE PIVOTALLY CONNECTED TO A BASE

[76] Inventor: Ferrari Franco, Fraz. Deviscio, 20053 Lecco (Como), Italy

[21] Appl. No.: 29,817

[22] Filed: Mar. 25, 1987

[30] Foreign Application Priority Data

Apr. 15, 1986 [IT] Italy ..... 21544/86[U]

[51] Int. Cl.[4] ..... E05D 7/04

[52] U.S. Cl. ..... 16/236; 16/240; 16/246; 16/382

[58] Field of Search ..... 16/237, 238–241, 16/243, 245, 246, 248, 288, 302, 370, 382, 236

[56] References Cited

U.S. PATENT DOCUMENTS

| | | | |
|---|---|---|---|
| 4,045,841 | 9/1977 | Rock et al. | 16/238 |
| 4,683,612 | 8/1987 | Grass | 16/240 |
| 4,691,408 | 9/1987 | Rock et al. | 16/241 |

FOREIGN PATENT DOCUMENTS

| | | | |
|---|---|---|---|
| 168595 | 1/1986 | European Pat. Off. | 16/382 |
| 2542028 | 3/1977 | Fed. Rep. of Germany | 16/382 |
| 698648 | 11/1965 | Italy | 16/382 |

*Primary Examiner*—Fred A. Silverberg

*Attorney, Agent, or Firm*—Finnegan, Henderson, Farabow, Garrett and Dunner

[57] ABSTRACT

A furniture hinge comprises, in combination: a first wing designed to be secured to the door of a piece of furniture and a second elongated-arm shaped wing designed to be applied to a base fixed to the shoulder of the piece of furniture, provision being made between the elongated-arm shaped wing and the base for regulating the position of the wing, depthwise and horizontally, and a securing screw passing through a slot in the arm to secure the wing to the base, wherein the securing screw screws onto a lever pivoted to the base.

1 Claim, 1 Drawing Sheet

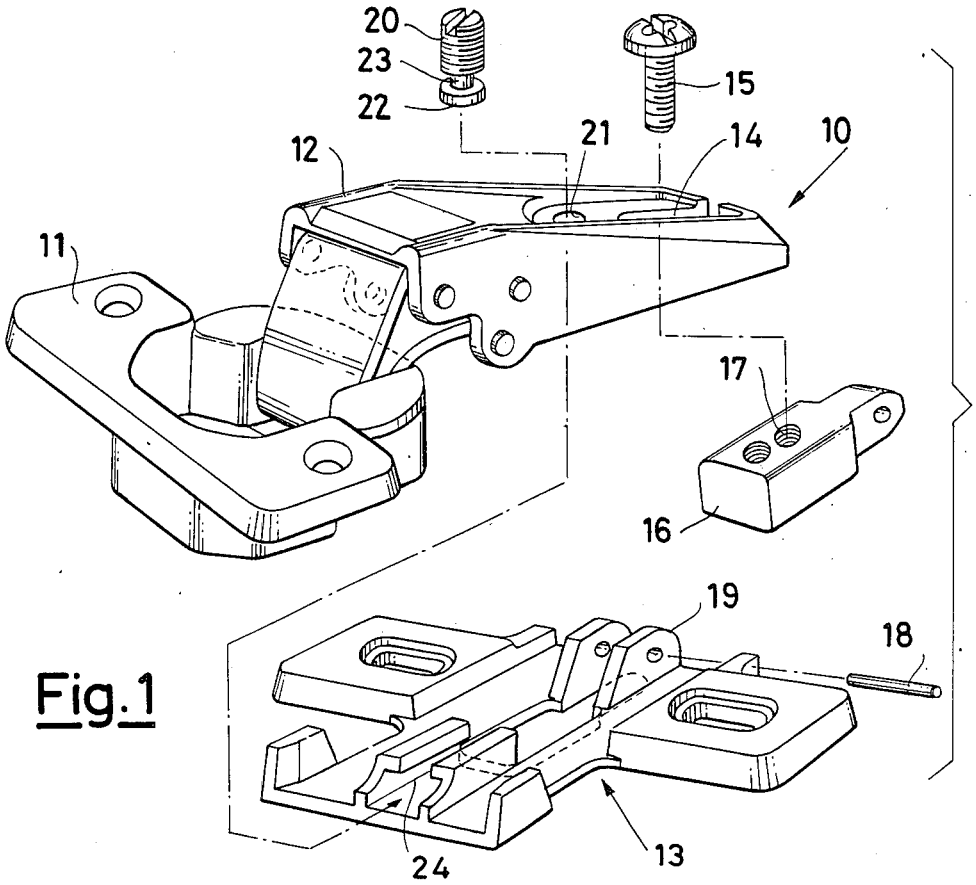
Fig. 1
Fig. 2
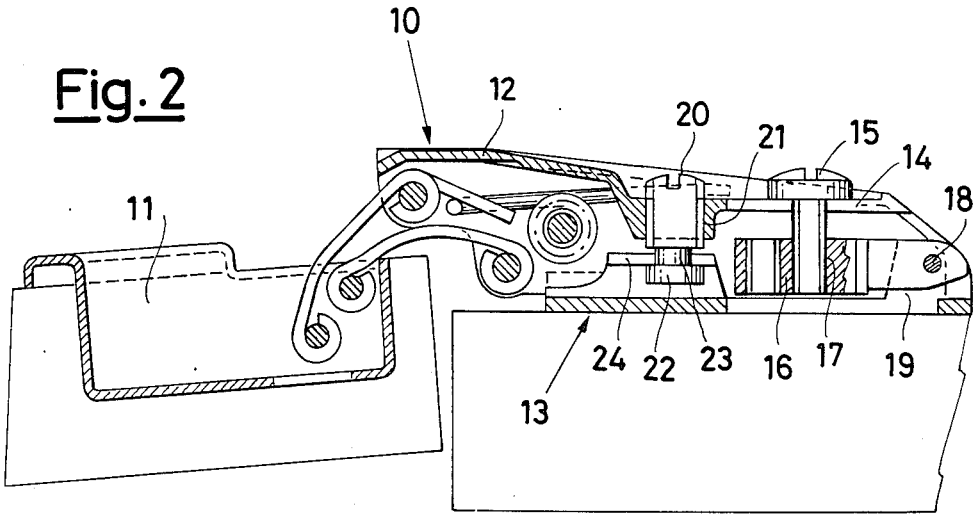

ARTICULATED FURNITURE HINGE PIVOTALLY CONNECTED TO A BASE

Furniture hinges consisting structurally of a pair of inter-articulated wings which are designed to be secured respectively to the door and to the fixed shoulder of a piece of furniture are well-known to persons with ordinary skill in the art.

More specifically, the wing that is secured to the door is generally box-shaped, while the other wing has the form of an elongated arm and is designed to be mounted on a base for the purpose on the shoulder of the piece of furniture.

Briefly, through the intermediary of its box-shaped wing the hinge is secured to the door, which is then restrained to the shoulder of the piece of furniture by securing the arm of the hinge to the base previously applied to the said shoulder.

It is also well known to make provision, between the arm of the hinge and the relative base, and between this and the shoulder, not only for fixing screws but also means for regulating the position of the hinge such as will permit the door to be mounted correctly; this is requisite in order to ensure satisfactory functioning both during opening and during closing, and also to ensure that the door, especially when closed, proves to be positioned as closely as possible to the edge of the shoulder of the piece of furniture.

In other words, there should be as little as possible free space between the edge of the shoulder of the piece of furniture and the edge of the door, since such space, or gap, is not only unsightly but a source of undesired infiltrations of dust into the interior of the piece of furniture as well.

The said regulation means enables the hinge to be fixed in the desired position according to three Cartesian coordinates in space.

It usually consists of anchoring means acting between arm and base of the hinge, by means of which both a regulation in depth and a horizontal regulation can be made.

The vertical regulation, on the other hand, is made by acting on the base, which is fixed to the shoulder of the piece of furniture by screws passing through slots provided on the said base.

The stable restraint between the arm of the hinge and the base is, on the other hand, ensured by means of a securing screw.

Lastly, it is known that it is highly desirable in the case of hinges of the aforesaid briefly described type to be able to make the depth regulation with the securing screw between arm and base already firmly screwed home.

The object of the present invention is to embody a hinge that, though very straighforward and economical in construction, fulfils the said desirable requirement.

To achieve this object the invention embodies a furniture hinge of the type comprising, in combination: a first wing designed to be secured to the door of a piece of furniture and a second wing having an elongated arm shape designed to be applied to a base secured to the shoulder of the piece of furniture, provision being made for means for regulating the position of the said wing, depthwise and horizontally, and for a securing screw passing through a slot in the arm so as to secure the wing to the base, wherein the said securing screw screws onto a lever pivoted to said base.

The structural and functional characteristics of the invention, and its advantages, will become more apparent from an examination of the following description, referred to the appended drawings which show an example of a hinge embodied according to the innovative principles of the invention.

In the drawings:

FIG. 1 is an enlarged perspective view of the said hinge;

FIG. 2 is a sectional view of the hinge of FIG. 1 after it has been assembled.

With reference to the drawings, the hinge is indicated overall by 10 and comprises two wings 11, 12 which are inter-articulated in a manner per se known and not shown in detail.

The wing 11 has a generally box-shaped form and is designed to be recessed into and fixed to the door of a piece of furniture, while the wing 12 has the form of an elongated arm and is designed to be fixed to the shoulder of the piece of furniture with interposition of a base 13.

The wing 12 features a longitudinal slot 14 open in its front portion, for the securing of a screw 15 which serves to secure the wing 12 to the base 13.

According to the innovative principle of the present invention, the mounting of the wing 12 onto the base 13 is effected with the interposition of a small lever 16. In its upper portion the said lever 16 features a threaded bore 17 within the securing screw 15 is screwed and tightened, and is at one end, through the intermediary of a pin 18, pivoted to a fork, 19 projecting from the base 13.

The numeral 20 indicates a two-directional (depthwise and horizontal) regulation screw, which is screwed through a bore 21 of the arm 12 and which, by means of a terminal head 22 with undercut 23, is anchored within a retention and guide seat 24 projecting from the base 13.

The foregoing description with reference to the appended drawings clearly evidences the fact that, as a result of the simple interposition of the lever 16, it becomes possible to act upon the screw 20 in order to regulate the depthwise position of the wing 12, with the securing screw 15 already tightened and thus with the entire system in a stable position.

I claim:

1. A furniture hinge device comprising, in combination:

(a) a first wing for attachment to a door of a piece of furniture;

(b) a second wing in the form of an elongated arm and having a longitudinal slot and a threaded bore;

(c) said first and second wings being interarticulated;

(d) a base member for attachment to a shoulder of the piece of furniture and having a retention and guide seat projecting from said base member adjacent a first end thereof and lever supporting means adjacent a second end thereof;

(e) a lever member for pivotal attachment to said lever supporting means, said lever member having a threaded bore;

(f) first screw means for insertion through said slot and for being screwed into said bore in said lever member to permit securing said second wing to said base member;

(g) second regulating screw means having a threaded portion for being screwed into said bore in said second wing and a terminal head with undercut for being anchored within said retention and guide seat; and (h) said device permitting the regulation of the horizontal and vertical positions of said second wing after said first screw means has been tightened in said bore in said lever member.

* * * * *